US007848692B2

(12) United States Patent
Saeki et al.

(10) Patent No.: US 7,848,692 B2
(45) Date of Patent: Dec. 7, 2010

(54) NEUTRALIZATION UNIT AND IMAGE FORMING APPARATUS HAVING A NEUTRALIZATION UNIT FOR REMOVING ELECTRIC CHARGE

(75) Inventors: Kazuchika Saeki, Atsugi (JP); Mitsuru Takahashi, Kawasaki (JP); Tsutomu Katoh, Kawasaki (JP); Takeshi Fukao, Yokohama (JP); Yoshiharu Kishi, Yokohama (JP); Kazuosa Kuma, Yokohama (JP)

(73) Assignee: Ricoh Co., Ltd., Tokyo (JP)

( * ) Notice: Subject to any disclaimer, the term of this patent is extended or adjusted under 35 U.S.C. 154(b) by 640 days.

(21) Appl. No.: 11/471,599

(22) Filed: Jun. 21, 2006

(65) Prior Publication Data

US 2006/0284958 A1 Dec. 21, 2006

(30) Foreign Application Priority Data

Jun. 21, 2005 (JP) ..... 2005-180320

(51) Int. Cl.
*G03G 15/14* (2006.01)

(52) U.S. Cl. ..... 399/315; 399/316

(58) Field of Classification Search ..... 399/315, 399/316; 430/110.3
See application file for complete search history.

(56) References Cited

U.S. PATENT DOCUMENTS 5,633,703 A * 5/1997 Takenouchi et al. ..... 399/315
5,698,354 A * 12/1997 Ugai et al. ..... 430/45.54
5,758,247 A * 5/1998 Yanashima et al. ..... 399/384
5,950,062 A 9/1999 Yahata et al.
5,983,060 A 11/1999 Namekata et al.
6,223,008 B1 4/2001 Takahashi et al.
6,336,025 B1 1/2002 Saeki
6,445,900 B2 9/2002 Fukao et al.

(Continued)

FOREIGN PATENT DOCUMENTS

JP 5-32751 5/1993

(Continued)

OTHER PUBLICATIONS

U.S. Appl. No. 11/739,391, filed Apr. 24, 2007, Yokokawa et al.

(Continued)

*Primary Examiner*—David P Porta
*Assistant Examiner*—Benjamin Schmitt
(74) *Attorney, Agent, or Firm*—Oblon, Spivak, McClelland, Maier & Neustadt, L.L.P.

(57) ABSTRACT

A neutralization unit for use in an image forming apparatus includes a support member made of an insulating material, an electric-charge removing member made of an electric conductive material, and a rib made of an insulating material. The electric-charge removing member, fixed on the support member, removes electric charge from a back face of the recording medium after a toner image is transferred to a front face of a recording medium at a transfer nip. The electric-charge removing member includes a plurality of exposed areas along a longitudinal direction of the electric-charge removing member. The rib, provided on the support member, has a curved peripheral side and protrudes from a surface of the electric-charge removing member. The back face of the recording medium is contactable at the curved peripheral side of the rib when the recording medium is transported from the transfer nip.

15 Claims, 7 Drawing Sheets

U.S. PATENT DOCUMENTS

| | | | | |
|---|---|---|---|---|
| RE38,206 | E | 7/2003 | Bisaiji et al. | |
| 6,611,672 | B2 | 8/2003 | Aoki et al. | |
| 6,690,905 | B2 | 2/2004 | Takahashi et al. | |
| 6,697,595 | B2 | 2/2004 | Kawagoe et al. | |
| 6,741,821 | B2 | 5/2004 | Sugino et al. | |
| 6,785,500 | B2 | 8/2004 | Takahashi et al. | |
| 6,829,450 | B2 | 12/2004 | Tamiya et al. | |
| 6,868,248 | B2 | 3/2005 | Fukao et al. | |
| 6,901,234 | B2 | 5/2005 | Ogiyama et al. | |
| 7,369,800 | B2 * | 5/2008 | Izumi et al. | 399/317 |
| 2003/0118359 | A1 | 6/2003 | Ogiyama et al. | |
| 2005/0047816 | A1 | 3/2005 | Uchida et al. | |
| 2005/0169667 | A1 | 8/2005 | Katoh | |
| 2005/0265755 | A1 | 12/2005 | Takahashi | |
| 2006/0056884 | A1 | 3/2006 | Sawai et al. | |
| 2006/0072929 | A1 | 4/2006 | Takahashi | |

FOREIGN PATENT DOCUMENTS

| | | |
|---|---|---|
| JP | 7-36287 | 2/1995 |
| JP | 9-40225 | 2/1997 |
| JP | 2003-57956 | 2/2003 |
| JP | 3577193 | 7/2004 |

OTHER PUBLICATIONS

U.S. Appl. No. 11/934,981, filed Nov. 5, 2007, Furuya, et al.
U.S. Appl. No. 11/943,941, filed Nov. 21, 2007, Katoh, et al.
U.S. Appl. No. 11/227,144. filed Sep. 16, 2005, Takahashi.

* cited by examiner

NEUTRALIZATION UNIT AND IMAGE FORMING APPARATUS HAVING A NEUTRALIZATION UNIT FOR REMOVING ELECTRIC CHARGE

BACKGROUND OF THE INVENTION

1. Field of the Invention

The present disclosure generally relates to an image forming apparatus having a neutralization unit configured to remove electric charge from a recording medium (e.g., transfer sheet), which has just passed through a transfer nip.

2. Description of the Related Art

In an image forming apparatus, toner images on an image carrying member can be directly transferred to a recording medium (e.g., transfer sheet) by a transfer unit, or toner images on the image carrying member can be transferred to an intermediate transfer member and then transferred to the recording medium.

In such an image forming apparatus, toner images are transferred to the recording medium at a transfer nip, formed between the transfer unit and the image carrying member (or intermediate transfer member), when the recording medium passes through the transfer nip. The transfer unit and the image carrying member (or intermediate transfer member) generate a transfer electric field at the transfer nip.

The transfer unit applies a transfer bias voltage to a back face of the recording medium (e.g., transfer sheet), wherein such transfer bias voltage has a relatively large voltage and a polarity, which is opposite to a polarity of toner images, on the image carrying member (or intermediate transfer member).

With such transfer bias voltage, toner images can be transferred to a front face of the recording medium from the image carrying member (or intermediate transfer member).

Because such transfer bias voltage is applied to the back face of the recording medium, the back face of the recording medium is charged with a polarity, which is same as the transfer bias voltage when the recording medium passes through the transfer nip. In other words, the back face of the recording medium is charged with polarity, which is opposite to a polarity of toner images on the image carrying member (or intermediate transfer member).

Such an electric charge on the back face of the recording medium may be used to retain toner images on the front face of the recording medium.

However, if the back face of the recording medium, which has just passed through the transfer nip, has too much electric charge thereon, an electrostatic adsorbability of the recording medium to the image carrying member may become too large, by which the recording medium may not be effectively separated from the image carrying member (or intermediate transfer member), and a sheet jamming may occur.

Furthermore, if the back face of the recording medium has too much electric charge, a sudden electric leak may occur from the back face of recording medium to parts (e.g., metal parts) provided around a transport path between the transfer nip and a fixing unit, by which toner images on the recording medium may be disturbed, and tiny circle-like patterns may occur on the toner images on the recording medium.

Furthermore, if the back face of the recording medium has too much electric charge, the front face of the recording medium may develop an electric charge, which has a polarity opposite to the polarity on the back face of the recording medium.

In such a condition, the electric charge on the front face of the recording medium may flow along the surface of the recording medium when the recording medium is transported in the transport path between the transfer nip and the fixing unit, by which toner images on the recording medium may be disturbed, and a lightning bolt pattern, which may correspond to a electric charge flow, may occur on the toner images on the front face of the recording medium.

In order to suppress such drawbacks, an image forming apparatus can include a neutralization unit, at a near portion of an exit of the transfer nip, to remove electric charge from a back face of a recording medium (e.g., transfer sheet) after the recording medium passes through the transfer nip.

The neutralization unit may include an electric-charge removing member, made of electric conductive material, and have a plurality of exposed areas along a longitudinal direction of the electric-charge removing member. The longitudinal direction of the electric-charge removing member may be arranged perpendicular to a transport direction of the recording medium. The plurality of exposed areas of the electric-charge removing member may be arranged closely to the back face of the recording medium.

With such a neutralization unit, excessive charge on the back face of the recording medium, which has passed through the transfer nip, can be removed, and thereby the above-mentioned drawbacks may be prevented.

In order to efficiently remove electric charge from the recording medium by such an electric-charge removing member, the plurality of exposed areas of the electric-charge removing member is preferably placed as close to the back face of the recording medium as possible, wherein the electric-charge removing member may be provided near the exit of the transfer nip.

Specifically, the plurality of exposed areas of the electric-charge removing member is placed in proximity to a nip tangent line of the transfer nip, wherein the nip tangent line is a tangent line extended from the transfer nip in a transport direction of the recording medium.

However, if the electric-charge removing member is arranged in such manner, the back face of the recording medium (e.g., transfer sheet), which has just passed through the transfer nip, may directly contact the electric-charge removing member because the recording medium may not be transported along the nip tangent line, but may sometimes be transported in a direction deviated from the nip tangent line.

If the back face of the recording medium contacts the electric-charge removing member, the electric charge on the back face of the recording medium may suddenly leak to the electric-charge removing member, and may result in the occurrence of an abnormal image (ie., an image that includes tiny circle-like patterns).

In order to prevent such contact between the recording medium and the electric-charge removing member, the neutralization unit may further include a plurality of ribs, which protrude from a surface of the plurality of exposed areas of the electric-charge removing member, wherein such ribs face toward the back face of the recording medium (e.g., transfer sheet).

FIG. 1A shows a schematic view for explaining a conventional neutralization unit provided near the transfer nip, and FIG. 1B shows an expanded view of the neutralization unit in FIG. 1A.

As shown in FIG. 1A, a recording medium S (e.g., transfer sheet) passes through a transfer nip, formed between an image carrying member (e.g., photoconductive member I) and a transfer unit (e.g., transfer roller 21).

The transfer roller 21, applied with a transfer bias voltage, can transfer toner images from the photoconductive member I to a front face of the recording medium S.

As shown in FIG. 1A, a neutralization unit 340 is provided in a downstream of a transport direction of the recording medium S and near the transfer nip.

As shown in FIG. 1B, the neutralization unit 340 includes an insulating support member 341, an electric-charge removing member 343, and a rib 342.

The electric-charge removing member 343, made of electrically conductive material, may be fixed on the insulating support member 341. The electric-charge removing member 343 is applied with an electric charge removing bias voltage, which has a polarity the same as toner images, from a power source (not shown), to remove electric charge from the back face of the recording medium S.

As shown in FIG. 1B, a plurality of exposed areas 343*a* are provided along a longitudinal direction B of the electric-charge removing member 343.

The longitudinal direction B of the neutralization unit 340 can be arranged in a direction perpendicular to a transport direction A of the recording medium S, and the exposed areas 343*a* can be placed in proximity to the back face of the recording medium S, which has just passed through the transfer nip.

As shown in FIG. 1B, the neutralization unit 340 includes a plurality of ribs 342, which may be made of insulating material.

Each of the ribs 342 may be integrally formed with the insulating support member 341 and each of the ribs 342 may be provided between adjacent exposed areas 343*a* as shown in FIG. 1B. Such ribs 342 are projected from each of the exposed areas 343*a* toward the back face of the recording medium S.

With such configuration, the back face of the recording medium S, which has just passed through the transfer nip, may not contact the electric-charge removing member 343 because the recording medium S may contact the ribs 342. In other words, the rib 342 prevents the back face of the recording medium S contacting the electric-charge removing member 343.

With such neutralization unit 340, a sudden electric-charge leaking from the back face of the recording medium S to the electric-charge removing member 343 may be prevented. Thus, an occurrence of an abnormal image, such as an image including tiny circle-like patterns, can be prevented.

However, if an image forming operation is conducted with the neutralization unit 340 having the ribs 342, streak lines may be produced on an image with a given interval, which corresponds to an interval of adjacent exposed areas 343*a* (or adjacent ribs 342), wherein streak lines may occur as an abnormal line image, extending in the transport direction A on the recording medium S.

The ribs 342 may cause such streak lines as discussed below. In general, streak lines may prominently appear on transfer sheets when printing a number of sheets continuously (e.g., at a time before completing continuous printing). During such printing, each of the ribs 342 may be charged by a friction with the back face of the recording medium S, and may accumulate electric charge, by which toner images on the front face of the recording medium S may be disturbed.

FIG. 2 shows a configuration for measuring the electric charge on the ribs 42.

As shown in FIG. 2, a surface electrometer can be connected to the insulating support member 341, and a value measured by the surface electrometer can be assumed as electric charge of the ribs 342. In one example measurement, the ribs 342 are charged to +3,000 to +4,000 V (voltage) when printing a number of sheets continuously (e.g., at a time before completing continuous printing), wherein such value is higher than a transfer bias voltage (e.g., +2,000 V).

Therefore, electric charge may be accumulated on the ribs 342 by a friction with the back face of the recording medium S, and the accumulated electric charge may disturb toner images on the front face of the recording medium S.

Such streak lines may be suppressed by reducing frictional electric charges formed on the ribs 342.

Making the ribs 342 with a material, which is hard to be charged by friction, can reduce the frictional electric charges on the ribs 342. However, an inexpensive insulating material such as ABS (acrylonitrile-butadiene-styrene) may be easily charged by friction, and a material hard to be charged by friction may unfavorably increase the manufacturing costs of the neutralization unit 340.

Similarly, the above-mentioned streak lines may occur when an image carrying member is applied with a transfer bias voltage, having a same polarity as that of the toner, to transfer toner images from the image carrying member to a recording medium (e.g., transfer sheet) at a transfer nip.

A shape of the ribs 342 may influence electric charge generated on the ribs 342 by a friction.

For example, the conventional rib 342 shown in FIG. 1B has a triangular shape when viewed from the longitudinal direction B of the electric-charge removing member 343, and one side of the triangular shaped rib 342 may extend in the transport direction A of the recording medium S.

Because the back face of the recording medium S, which has just passed through the transfer nip, may move along such one side of the ribs 342, the back face of the recording medium S may be frictioned with the one side of the ribs 342, which has a relatively larger area, and frictional electric charge generated one the rib 342 may become large.

SUMMARY

The present disclosure relates to a neutralization unit for use in an image forming apparatus. The neutralization unit includes a support member made of an insulating material, an electric-charge removing member made of an electric conductive material, and a rib made of an insulating material. The electric-charge removing member, fixed on the support member, removes electric charge from a back face of the recording medium after a toner image is transferred to a front face of a recording medium at a transfer nip. The electric-charge removing member includes a plurality of exposed areas along a longitudinal direction of the electric-charge removing member. The rib, provided on the support member, has a curved peripheral side and protrudes from a surface of the electric-charge removing member. The back face of the recording medium is contactable at the curved peripheral side of the rib when the recording medium is transported from the transfer nip.

The present disclosure further relates to an image forming apparatus having a neutralization unit. The image forming apparatus includes an image carrying member, a transfer unit, and a neutralization unit. The image carrying member carries an image formed with toner thereon. The transfer unit transfers the image from the image carrying member to a recording medium at a transfer nip by generating a transfer electric field when the recording medium passes through the transfer nip. The neutralization unit removes electric charge from a back surface of the recording medium after the image is transferred to a front surface of the recording medium.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

DETAILED DESCRIPTION OF EXAMPLE EMBODIMENTS

Figure 1A:
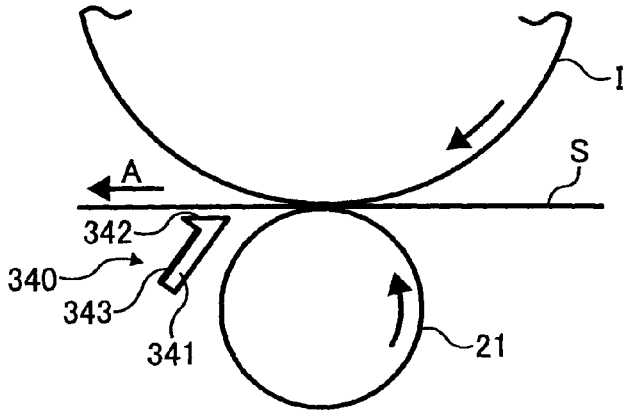
FIG. 1A BACKGROUND ART
FIG. 1A is a schematic view explaining a conventional neutralization unit provided near a transfer nip.

In describing the exemplary embodiments shown in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, an image forming apparatus according to an exemplary embodiment is described with reference to FIG. 3.

Figure 3:
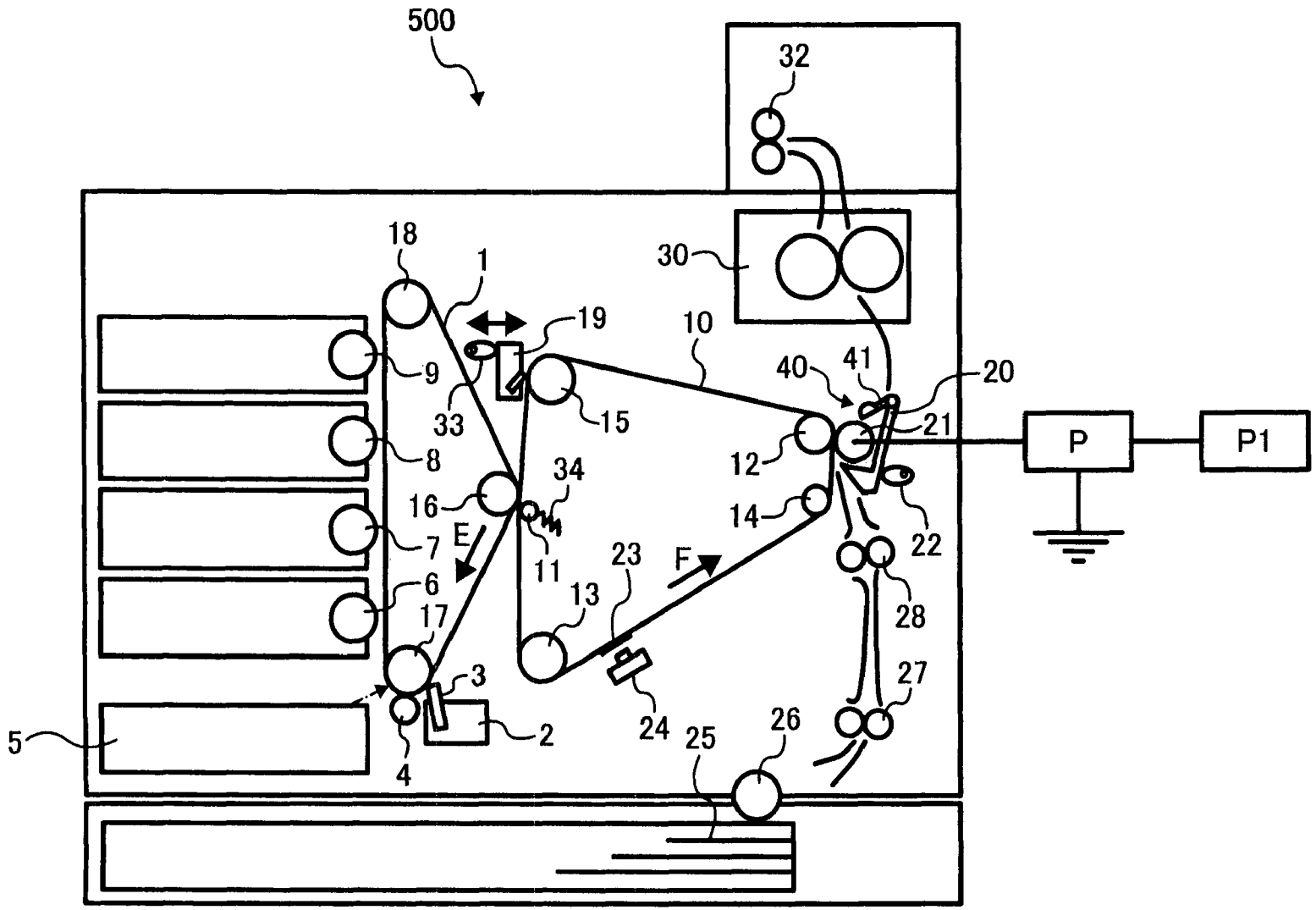
FIG. 3 is a schematic configuration of an image forming apparatus according to an example embodiment.

FIG. 3 is a schematic configuration of an image forming apparatus 500 according to an exemplary embodiment.

The image forming apparatus 500 includes a photoconductive belt 1, a cleaning unit 2, a charger 4, an optical writing unit 5, developing units 6 to 9, an intermediate transfer belt 10, a secondary transfer unit 20, a neutralization unit 40, and a fixing unit 30.

The photoconductive belt 1, functioning as image carrying member, travels in a direction shown by an arrow E in FIG. 3.

As shown in FIG. 3, the photoconductive belt 1 is extended by a drive roller 17, a tension roller 18, and a primary transfer roller 16.

Around the photoconductive belt 1, the cleaning unit 2 having a cleaning blade 3 is provided to clean the photoconductive member 1. The charger 4 is provided to uniformly charge the photoconductive member 1. The optical writing unit 5 is provided to write a latent image on the photoconductive member 1 with a light beam. The intermediate transfer belt 10 is provided as intermediate transfer member for toner image.

Furthermore, four developing units are provided along the photoconductive belt 1, wherein the developing units includes a yellow developing unit 6, a magenta developing unit 7, a cyan developing unit 8, and a black developing unit 9.

In the image forming apparatus 500, a full color image is formed by forming toner images of yellow, magenta, cyan, and black with such order on the photoconductive belt 1, and then the toner images are transferred to the intermediate transfer belt 10 sequentially to form a full color image on the intermediate transfer belt 10.

As shown in FIG. 3, the intermediate transfer belt 10 is extended by a drive roller 13, a primary transfer bias roller 11, a secondary transfer roller 12, a tension roller 14, and a roller 15. The intermediate transfer belt 10 can travel in a direction shown by an arrow F in FIG. 3. Such rollers extending the intermediate transfer belt 10 are supported by a side plate (not shown) for an intermediate transfer belt unit.

As shown in FIG. 3, the primary transfer bias roller 11 is pressed toward the photoconductive belt 1 by a spring 34.

The intermediate transfer belt 10 may include a single layer made of PVDF (polyvinylidene fluoride), ETFE (ethylene-tetrafluororethylene), PI (polyimide), and PC (polycarbonate) or a plurality of layers made of PVDF, ETFE, PI, and PC, for example. An electrically conductive material such as carbon black may be dispersed in such layer of the intermediate transfer belt 10.

With such process, a volume resistivity of the intermediate transfer belt 10 can be preferably set to a range of $10^8$ to $10^{12}$ Ω·cm, and a surface resistivity of the intermediate transfer belt 10 can be preferably set to a range of $10^8$ to $10^{15}$ Ω/sq.

If the volume resistivity and surface resistivity of the intermediate transfer belt 10 becomes too large, a transfer bias voltage may need to be set to a higher value, by which a power source cost may unfavorably increase.

Furthermore, a higher transfer bias voltage may increase a charging potential of the intermediate transfer belt 10, and may result into a poor self-discharge ability of the intermediate transfer belt 10, by which a manufacturing cost of the image forming apparatus may increase because a neutralization unit is required to remove electric charge from a highly charged intermediate transfer belt 10.

If the volume resistivity and surface resistivity of the intermediate transfer belt 10 becomes too low, the intermediate transfer belt 10 may be attenuated faster, which is favorable for removing electric charge by self-discharge. However, toner scattering may occur because a transfer current is more likely to flow on the surface of the intermediate transfer belt 10.

Accordingly, the volume resistivity and surface resistivity of the intermediate transfer belt 10 are preferably set to a range of $10^8$ to $10^{12}$ Ω·cm, and a range of $10^8$ to $10^{15}$ Ω/sq, respectively.

The volume resistivity and surface resistivity of the intermediate transfer belt 10 can be measured with a high resistivity measurement device (Hiresta IP, manufactured by Mitsubishi Petrochemical Co., Ltd) and a measurement probe HRS (having a diameter of 5.9 mm for an inner electrode and an inner diameter of 11 mm for a ring electrode) connected to the Hiresta IP.

A given voltage (e.g., 100 V) is applied to a front and back face of the intermediate transfer belt 10 for ten seconds for measuring the volume resistivity, and a given voltage (e.g., 500 V) is applied for measuring the surface resistivity in a similar manner.

Furthermore, the front face of the intermediate transfer belt 10 may be coated with a separation layer, as required.

The separation layer may be made of fluorocarbon polymer such as ETFE (ethylene-tetrafluororethylene), PTFE (polytetrafluoroethylene), PVDF (polyvinylidene fluoride), PEA (perfluoroalkoxy), FEP (fluorinated ethylene propylene), and PVF (polyvinyl fluoride), but not limited to these materials.

The intermediate transfer belt 10 can be made by any method such as cast molding method, and centrifugal molding, and the surface of the intermediate transfer belt 10 can be polished, as required.

As shown in FIG. 3, a belt cleaning unit 19 and a contacting unit 33 are provided for the intermediate transfer belt 10. The belt cleaning unit 19 can be contacted to the intermediate transfer belt 10 by the contacting unit 33.

When a four-color toner image is primarily transferred to the intermediate transfer belt 10 from the photoconductive belt 1, the belt cleaning unit 19 is separated from the intermediate transfer belt 10 by the contacting unit 33.

After completing a secondary transfer operation, which transfers toner images on the intermediate transfer belt 10 to a transfer sheet 25 (i.e., recording medium), the belt cleaning unit 19 is contacted to the intermediate transfer belt 10 at a given timing to remove any toner remaining on the intermediate transfer belt 10.

Furthermore, a mark sensor 24 is provided for the intermediate transfer belt 10. The mark sensor 24 detects a belt position mark 23, which is provided at a lateral portion on a front face of the intermediate transfer belt 10. Image forming process of each color can be started at a given timing when the mark sensor 24 detects the belt position mark 23 so that each color toner images can be correctly transferred.

Furthermore, the secondary transfer unit 20 is provided for the intermediate transfer belt 10 as shown in FIG. 3. The secondary transfer unit 20 includes a secondary transfer bias roller 21, a contacting unit 22, a secondary transfer power source P, and a power controller P1.

The secondary transfer bias roller 21 can be contacted to the intermediate transfer belt 10 by the contacting unit 22. The secondary transfer bias roller 21 is applied with a secondary transfer bias voltage from the secondary transfer power source P. The power controller P1 controls the secondary transfer bias voltage.

The secondary transfer bias roller 21 includes a core and an elastic layer coated on the core. The core can be made of metal such as SUS (stainless steel), and the elastic layer can be made of an electrically conductive material such as urethane, wherein the electrically conductive material may have a resistance value in a range of $10^6$ to $10^{10}$ Ω, for example.

If the resistance value of the secondary transfer bias roller 21 becomes too large, a transfer current does not easily flow in the secondary transfer bias roller 21, and thereby a higher voltage may be required for maintaining a good transferability. However, higher power source costs unfavorably increase the cost of the apparatus. Furthermore, if such higher voltage is applied, a discharge of electricity may occur at a space around the secondary transfer nip, by which a blank area may occur on a halftone image. A transfer nip is defined as the area between the image carrying member and the transfer unit.

If the resistance value of the secondary transfer bias roller 21 becomes too small, good transferability may not be obtained for both of an image area having superimposed multiple color toner images and an image area having single color toner image.

If a secondary transfer bias voltage is set to a relatively lower voltage to obtain a transfer current, which is suitable for single color toner image, such transfer current may be too low for maintaining a good transferability for a multiple color image area.

On one hand, if a secondary transfer bias voltage is set to a relatively higher voltage to obtain a transfer current, which is suitable for a multiple color image area, such transfer current may not be suitable for single color image area because such transfer current may be too large for single color image area.

Accordingly, if the resistance value of the secondary transfer bias roller 21 becomes too small, image transfer efficiency may decrease.

The resistance value of the secondary transfer bias roller 21 can be computed as below. The secondary transfer bias roller 21 is placed on the electrically conductive metal plate, and a force of 4.9 N is applied to each end of the core (a total force of 9.8 N). Under such condition, a voltage of 1,000 V is applied between the core and metal plate to obtain an electric current value. Based on such electric current value, the resistance value of the secondary transfer bias roller 21 can be computed.

The secondary transfer bias roller 21 can be rotated by a drive gear (not shown). A circumferential velocity of the secondary transfer bias roller 21 can be set to be substantially the same as a circumferential velocity of the intermediate transfer belt 10, and the secondary transfer bias roller 21 rotates in a same direction with the intermediate transfer belt 10 at a secondary transfer nip.

The secondary transfer bias roller 21 can be pressed toward the intermediate transfer belt 10 by the contacting unit 22 before toner images are transferred from the intermediate transfer belt 10 to the transfer sheet 25 The secondary transfer power source P applies a given secondary transfer bias voltage to the secondary transfer bias roller 21.

Furthermore, the neutralization unit 40 is provided at a downstream of a secondary transfer nip of the intermediate transfer belt 10.

The neutralization unit 40 is used to remove electric charge from a back face of the transfer sheet 25, which has just passed trough the secondary transfer nip. The neutralization unit 40 will be described in detail later.

The transfer sheet 25 is fed to the secondary transfer nip by a sheet feed roller 26, a transport roller 27, and a registration roller 28 at a given timing, which is synchronized with a transfer timing of toner images from the intermediate transfer belt 10.

Toner images transferred to the transfer sheet 25 are fixed by the fixing unit 30, and then the transfer sheet 25 is ejected outside of the image forming apparatus 500 by an ejection roller 32.

Hereinafter, an image forming operation in the image forming apparatus 500 is explained.

At first, the photoconductive belt 1 is uniformly charged to a given potential (e.g., −500 V) by the charger 4, and then the optical writing unit 5 writes an electrostatic latent image for yellow on the photoconductive belt 1.

The yellow developing unit 6 develops the electrostatic latent image on the photoconductive belt 1 as yellow toner image with yellow toner. The yellow developing unit 6 is applied with a given developing bias voltage (e.g., −300 V).

The primary transfer bias roller 11 is applied with a primary transfer bias voltage from a high voltage power source (not shown). The primary transfer bias roller 11 applies electric charge to the inner surface of the intermediate transfer belt 10 by contacting with the intermediate transfer belt 10.

With an effect of the primary transfer bias roller 11, the yellow toner image is transferred from the photoconductive belt 1 to the intermediate transfer belt 10. The primary transfer bias voltage is set to a given voltage (e.g., +700 V). After transferring the yellow toner image, the photoconductive belt 1 is cleaned by the cleaning unit 2.

After cleaning the photoconductive belt 1, the photoconductive belt 1 is uniformly charged to a given potential (e.g., −500 V) by the charger 4 again, and then the optical writing unit 5 writes an electrostatic latent image for magenta on the photoconductive belt 1.

The magenta developing unit 7 develops the electrostatic latent image on the photoconductive belt 1 as magenta toner image with magenta toner. The magenta developing unit 7 is applied with a given developing bias voltage (e.g., −300 V).

The primary transfer bias roller 11 is applied with a primary transfer bias voltage from a high voltage power source (not shown). The primary transfer bias roller 11 applies electric charge to the inner surface of the intermediate transfer belt 10 by contacting with the intermediate transfer belt 10.

With an effect of the primary transfer bias roller 11, the magenta toner image is transferred from the photoconductive belt 1 to the intermediate transfer belt 10 while the magenta toner image is superimposed on the yellow toner image on the intermediate transfer belt 10. The primary transfer bias voltage for transferring magenta toner image is set to a given voltage (e.g., +800 V). After transferring the magenta toner image, the photoconductive belt 1 is cleaned by the cleaning unit 2.

After cleaning the photoconductive belt 1, the photoconductive belt 1 is uniformly charged to a given potential (e.g., −500 V) by the charger 4 again, and then the optical writing unit 5 writes an electrostatic latent image for cyan on the photoconductive belt 1.

The cyan developing unit 8 develops the electrostatic latent image on the photoconductive belt 1 as cyan toner image with cyan toner. The cyan developing unit 8 is applied with a given developing bias voltage (e.g., −300 V).

The primary transfer bias roller 11 is applied with a primary transfer bias voltage from a high voltage power source (not shown). The primary transfer bias roller 11 applies electric charge to the inner surface of the intermediate transfer belt 10 by contacting with the intermediate transfer belt 10.

With an effect of the primary transfer bias roller 11, the cyan toner image is transferred from the photoconductive belt 1 to the intermediate transfer belt 10 while the cyan toner image is superimposed on the yellow and magenta toner image on the intermediate transfer belt 10. The primary transfer bias voltage for transferring cyan toner image is set to a given voltage (e.g., +900 V). After transferring the cyan toner image, the photoconductive belt 1 is cleaned by the cleaning unit 2.

Furthermore, after cleaning the photoconductive belt 1, the photoconductive belt 1 is uniformly charged to a given potential (e.g., −500 V) by the charger 4 again, and then the optical writing unit 5 writes an electrostatic latent image for black on the photoconductive belt 1.

The black developing unit 9 develops the electrostatic latent image on the photoconductive belt 1 as black toner image with black toner. The black developing unit 9 is applied with a given developing bias voltage (e.g., −300 V).

The primary transfer bias roller 11 is applied with a primary transfer bias voltage from a high voltage power source (not shown). The primary transfer bias roller 11 applies electric charge to the inner surface of the intermediate transfer belt 10 by contacting with the intermediate transfer belt 10.

With an effect of the primary transfer bias roller 11, the black toner image is transferred from the photoconductive belt 1 to the intermediate transfer belt 10 while the black toner image is superimposed on the yellow, magenta, and cyan toner image on the intermediate transfer belt 10. The primary transfer bias voltage for transferring black toner image is set to a given voltage (e.g., +900 V). After transferring the black toner image, the photoconductive belt 1 is cleaned by the cleaning unit 2.

A full-color toner image on the intermediate transfer belt 10 is transferred to the transfer sheet 25, fed by the sheet feed roller 26 and registration roller 28, with an effect of the secondary transfer bias roller 21.

After removing electric charge from the back face of the transfer sheet 25 with the neutralization unit 40, the transfer sheet 25 is transported to the fixing unit 30. The fixing unit 30 fixes the full color toner images on the transfer sheet 25. Then, the transfer sheet 25 is ejected out side of the image forming apparatus 500.

The image forming apparatus 500 can conduct an image forming of single color mode, two color mode, three color mode, and full color mode.

In the single color mode, any one of yellow, magenta, cyan, and black image is formed on the transfer sheet 25.

In the two color mode, any combination of two colors selected from yellow, magenta, cyan, and black is formed on the transfer sheet 25.

In the three color mode, any combination of three colors selected from yellow, magenta, cyan, and black is formed on the transfer sheet 25.

In the full color mode, all of yellow, magenta, cyan, and black image are superimposed on the transfer sheet 25 as above described.

A user can select these modes from an operation panel (not shown) for the image forming apparatus 500.

In the single color mode, a single color toner image is formed on the photoconductive belt 1 and transferred to the intermediate transfer belt 10.

In the two color mode, a two-color toner image is formed on the photoconductive belt 1 and transferred to the intermediate transfer belt 10.

In the three color mode, a three-color toner image is formed on the photoconductive belt 1 and transferred to the intermediate transfer belt 10.

In the full color mode, a full color toner image is formed on the photoconductive belt 1 and transferred to the intermediate transfer belt 10.

Such single color toner image, two-color toner image, three-color toner image, and full-color toner image are transferred to the transfer sheet 25 from the intermediate transfer belt 10 with an effect of the secondary transfer bias roller 21.

When an image forming operation is conducted continuously for a given number of transfer sheets, the secondary transfer bias roller 21 is contacted to the intermediate transfer belt 10 at given timings by the contacting unit 22.

Furthermore, the toner used in these exemplary embodiments includes polymerized toner, which can be made by a polymerization method. Furthermore, the toner used in these exemplary embodiments preferably has a first shape factor SF-1 of 100 to 180 and a second shape factor SF-2 of 100 to 180.

Figure 4:
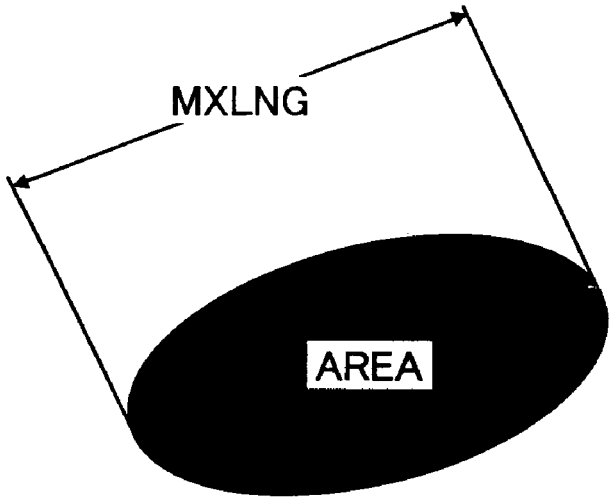
FIG. 4 is a schematic view explaining a first shape factor SF-1 of a toner particle.
Figure 5:
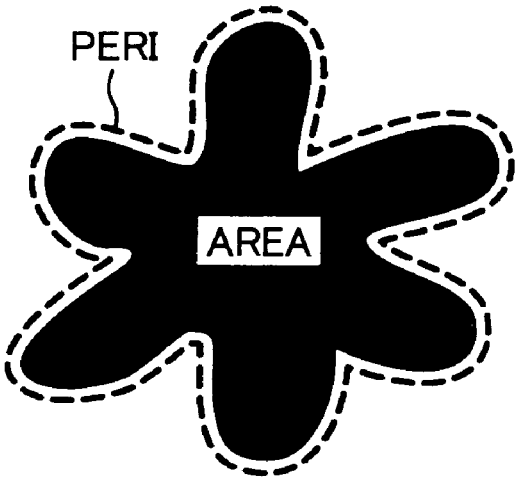
FIG. 5 is a schematic view explaining a second shape factor SF-2 of a toner particle.

FIGS. 4 and 5 are schematic views for explaining the first and second shape factors SF-1 and SF-2, respectively.

As illustrated in FIG. 4, the first shape factor SF-1 represents the degree of the roundness of a toner particle and is defined by the following equation (1):

$$SF\text{-}1=\{(\mathrm{MXLNG})^2/(\mathrm{AREA})\}\times(100\pi/4) \quad (1)$$

wherein MXLNG represents a diameter of the circle circumscribing the image of a toner particle, which image is obtained by observing the toner particle with a microscope; and AREA represents the area of the image.

When the SF-1 is 100, the toner particle has a true spherical form. When the SF-1 is too large, the toner particles have irregular forms, and thereby the toner has poor developability and poor transferability.

As illustrated in FIG. 5, the second shape factor SF-2 represents the degree of the concavity and convexity of a toner particle, and is defined by the following equation (2):

$$SF\text{-}2=\{(\mathrm{PERI})^2/(\mathrm{AREA})\}\times(100/4\pi) \quad (2)$$

wherein PERI represents the peripheral length of the image of a toner particle observed by a microscope; and AREA represents the area of the image.

When the SF-2 approaches 100, the toner particles have a smooth surface (i.e., the toner has little concavity and convexity). When the SF-2 is too large (i.e., the toner particles are seriously roughened), the toner particles have a rough surface (i.e., the toner has much concavity and convexity).

The shape factors SF-1 and SF-2 are determined by the following method:

(1) particles of a toner are photographed using a scanning electron microscope (S-800 manufactured by Hitachi Ltd.); and (2) photograph images of 100 toner particles are analyzed using an image analyzer (LUZEX 3 manufactured by Nireco Corp.) to determine the SF-1 and SF-2.

When the SF-1 approaches 100, the toner particle has a true spherical form. In this case, the toner particles contact the other toner particles and an image carrying member (e.g., photoconductive belt 1) at one point. Therefore, the adhesion of the toner particles to the other toner particles and the image carrying member (e.g., photoconductive belt 1) decreases, resulting in an increase of the fluidity of the toner particles and the transferability of the toner.

When the SF-1 or SF-2 becomes too large (e.g., over 180), the toner particles have irregular forms. Thus, the toner has poor developability, poor transferability, and poor cleanability when such toner is adhered on a transfer member.

Furthermore, the toner particles preferably have a volume average particle diameter of from 4 to 10 μm.

When the particle diameter of the toner is too small, the fluidity of the toner deteriorates and may be more likely to aggregate. Thus, high quality images cannot be produced.

When the particle diameter of the toner is too large, toner scattering or poor resolution of the toner images may occur. Thus, high quality images with high sharpness (i.e., without toner scattering) cannot be produced.

The toner particles for use in the example embodiment preferably have a volume average particle diameter of approximately 6.5 μm, for example.

Hereinafter, the neutralization unit 40 for use in an image forming apparatus 500 is explained with reference to FIG. 6.

The neutralization unit 40 is provided near to and downstream of the secondary transfer nip in the image forming apparatus 500. The neutralization unit 40 removes an electric charge from a back face of the transfer sheet 25.

Figure 6:
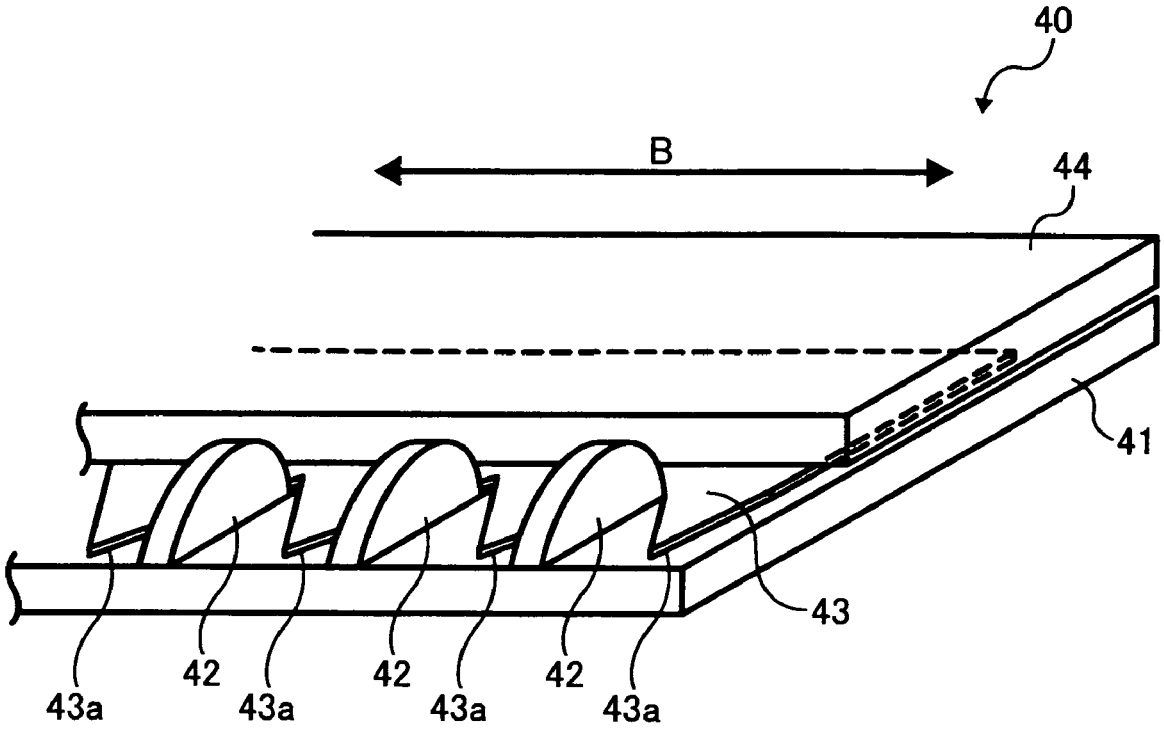
FIG. 6 is an expanded view of a neutralization unit according to an example embodiment.

The neutralization unit 40 includes a support plate 41, a rib 42, an electric-charge removing member 43, and a cover plate 44 as shown in FIG. 6.

The support plate 41 can be made of an insulating material. The rib 42 can also be made of an insulating material, and may be integrally formed with the support plate 41. The electric-charge removing member 43 made of electrically conductive material is provided on the support plate 41. As shown in FIG. 6, a plurality of ribs can be provided on the support plate 41 so that the rib 42 includes a single rib and a plurality of ribs.

The neutralization unit 40 also includes a power source (not shown), which applies an electric charge removing bias voltage to the electric-charge removing member 43, wherein the electric charge removing bias voltage has a same polarity as the toner in an exemplary embodiment, for example. In other words, the polarity of the electric charge removing bias voltage is opposite to a polarity of the secondary transfer bias voltage, for example.

As shown in FIG. 6, the electric-charge removing member 43 includes a plurality of exposed areas 43*a* for removing electric charge from the back face of the transfer sheet 25.

When the electric charge removing bias voltage is applied to the electric-charge removing member 43, a corona charging occurs between the exposed areas 43*a* and the back face of the transfer sheet 25, by which electric charge can be removed from the back face of the transfer sheet 25.

Figure 7:
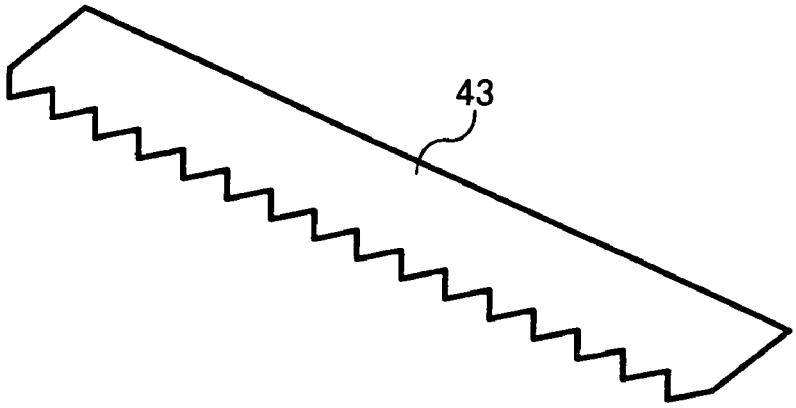
FIG. 7 is a perspective view of an electric-charge removing member in a neutralization unit in FIG. 6.

FIG. 7 shows a perspective view of the electric-charge removing member 43.

The electric-charge removing member 43 can be made of stainless steel such as SUS 301. For example, one side of a rectangular shape of stainless steel (e.g., SUS 301) having a thickness of 0.2 mm may be processed in a shape of saw-tooth appearances, wherein the saw-tooth appearances area becomes the exposed areas 43*a*.

Such saw-tooth appearances can be processed to become the electric-charge removing member 43 with a known manufacturing process.

Adjacent saw-teeth of the exposed areas 43*a* have, for example, a tooth pitch of 3 mm.

As shown in FIG. 6, the electric-charge removing member 43 can be fixed on the support plate 41, which has a larger area than the electric-charge removing member 43.

As shown in FIG. 6, the plurality of ribs 42 can be integrally formed with the support plate 41, and each of the ribs 42 can be placed between adjacent exposed areas 43*a* of the electric-charge removing member 43.

Each of the ribs 42 is projected from a surface of the electric-charge removing member 43. Specifically, each of the ribs 42 extends in a direction of a normal line extending from the surface of the electric-charge removing member 43.

When the neutralization unit 40 having such configuration is provided near to and downstream of the secondary transfer nip of the image forming apparatus 500, the back face of the transfer sheet 25 can face the exposed areas 43*a* by interposing the ribs 42 between the transfer sheet 25 and the electric-charge removing member 43.

Furthermore, as shown in FIG. 6, the electric-charge removing member 43 fixed on the support plate 41 can be covered by the cover plate 44 while exposing the exposed areas 43*a* of the electric-charge removing member 43, wherein the cover plate 44 can be made of an insulating material.

With such configuration, the electric-charge removing member 43 can be sandwiched between the support plate 41 and cover plate 44.

Although the cover plate 44 may not be required for the neutralization unit 40, the cover plate 44 may be preferably provided in the neutralization unit 40.

As above discussed, the electric charge can be removed from the back face of the transfer sheet 25 when the corona charging occurs between the exposed areas 43*a* and the back face of the transfer sheet 25.

If the electric-charge removing member 43 is not covered by the cover plate 44, all surface of electric-charge removing member 43 is exposed. In such a configuration, the back face of the transfer sheet 25 may directly contact at any surface area of the electric-charge removing member 43, by which an unfavorable charge discharging may occur between the back face of the transfer sheet 25 and the electric-charge removing member 43. Such unfavorable discharging of electricity may result into a disturbance of the toner images (i.e., toner scattering) on the transfer sheet 25.

Accordingly, the neutralization unit 40 is preferably provided with the cover plate 44 to prevent a direct contact of the transfer sheet 25 and the electric-charge removing member 43.

Figure 8:
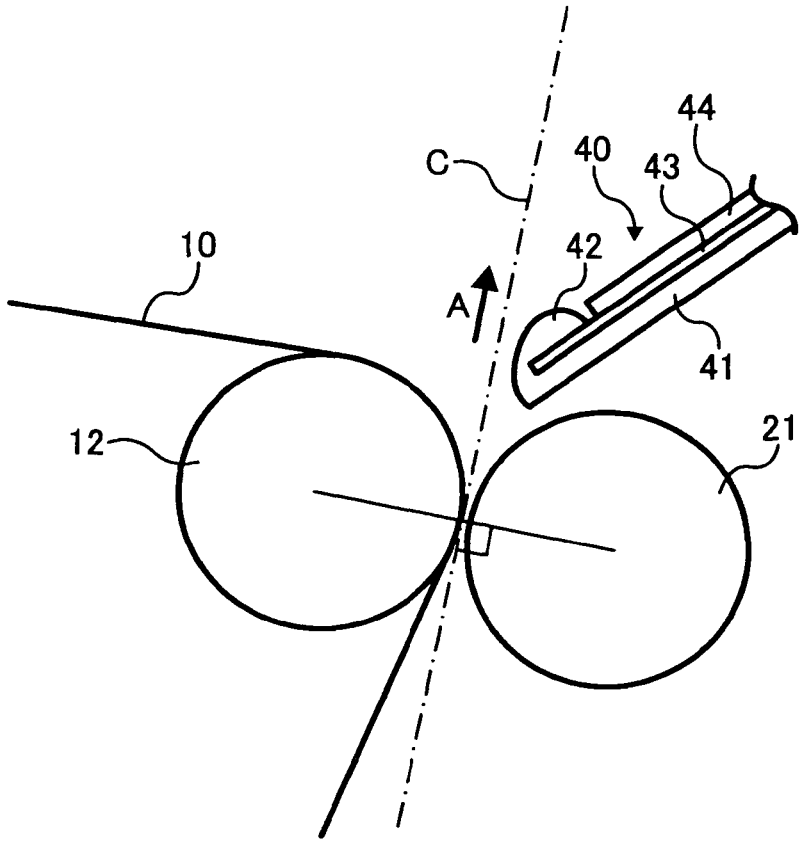
FIG. 8 is a schematic view explaining a configuration of an embodiment near a transfer nip in an image forming apparatus.

FIG. 8 is a schematic view explaining a configuration near the secondary transfer nip in the image forming apparatus 500.

The support plate 41 having the electric-charge removing member 43 and cover plate 44 thereon can be provided near the secondary transfer nip as shown in FIG. 8.

The longitudinal direction B of the support plate 41 is perpendicular to a transport direction A of the transfer sheet 25. In other words, the longitudinal direction B of the support plate 41 is parallel to an axis direction of the secondary transfer bias roller 21.

As shown in FIG. 8, the support plate 41 faces the secondary transfer bias roller 21, and the cover plate 44 does not face the secondary transfer bias roller 21.

With such configuration, the electric-charge removing member 43 can be shielded from the secondary transfer bias roller 21 by the support plate 41, made of insulating material, so that the electric-charge removing member 43 may not be affected by the secondary transfer bias roller 21.

Therefore, when the electric-charge removing member 43 is applied with the electric charge removing bias voltage, a corona discharge can occur at the exposed areas 43*a* in a stable manner.

Furthermore, as shown in FIG. 8, it is preferable not to place the ribs 42 of the neutralization unit 40 on an extended line C (dotted line in FIG. 8), wherein the extended line C is a nip tangent line extended from the secondary transfer nip.

In general, the transfer sheet 25, passed through the secondary transfer nip, is transported along the extended line C. Therefore, if the ribs 42 are placed on the extended line C, the back face of the transfer sheet 25 may contact the ribs 42 with a higher frequency, by which the back face of the transfer sheet 25 and the ribs 42 may be in contact with each other for a longer period of time.

If the neutralization unit 40 is provided in a position, which can avoid placing the ribs 42 on the extended line C, the back face of the transfer sheet 25 may contact the ribs 42 with a lower frequency. Thus, the back face of the transfer sheet 25 and the ribs 42 may be in contact with each other for a shorter period of time when the transfer sheet 25 is transported.

Accordingly, frictional electric charge generated by friction between the ribs 42 and the back face of the transfer sheet 25 may be suppressed.

Figure 9:
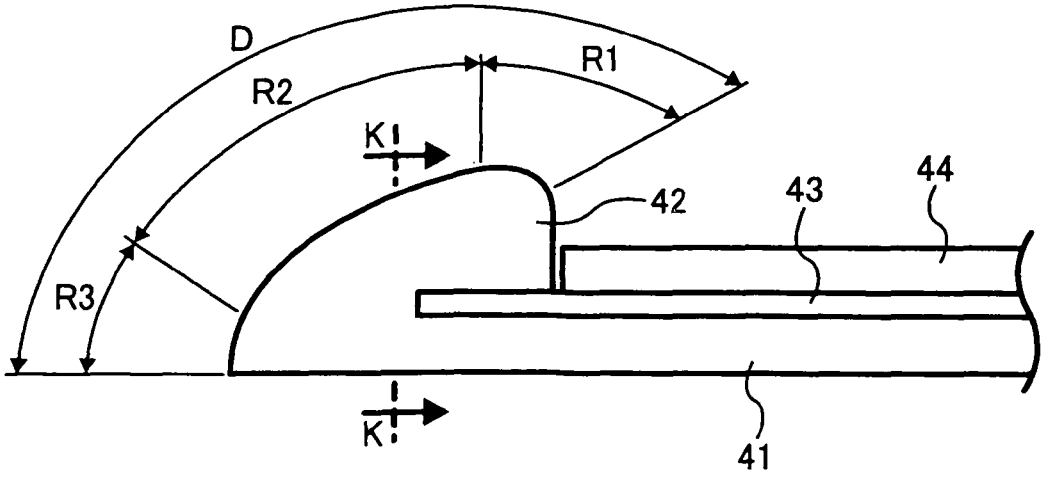
FIG. 9 is a schematic side cross-sectional view of a rib and electric-charge removing member in the neutralization unit shown in FIG. 6.

FIG. 9 is a schematic side cross-sectional view of the rib 42 and the electric-charge removing member 43 in the neutralization unit 40, when viewed from the longitudinal direction B of the electric-charge removing member 43.

As shown in FIG. 9, the rib 42 includes a contactable area D, which is formed into a curved shape (or curved peripheral side). The transfer sheet 25, passed through the secondary transfer nip, may contact the contactable area D with the back face of the transfer sheet 25.

The contactable area D formed into a curved shape may have a plurality of curvatures. For example, the contactable area D can include three curvatures: a first curvature radius R1 of 1 mm; a second curvature radius R2 of 7 mm; and a third curvature radius R3 of 3 mm.

Although the contactable area D has three curvatures in FIG. 9, the contactable area D can have a plurality of curvatures other than three curvatures.

Figure 1B:
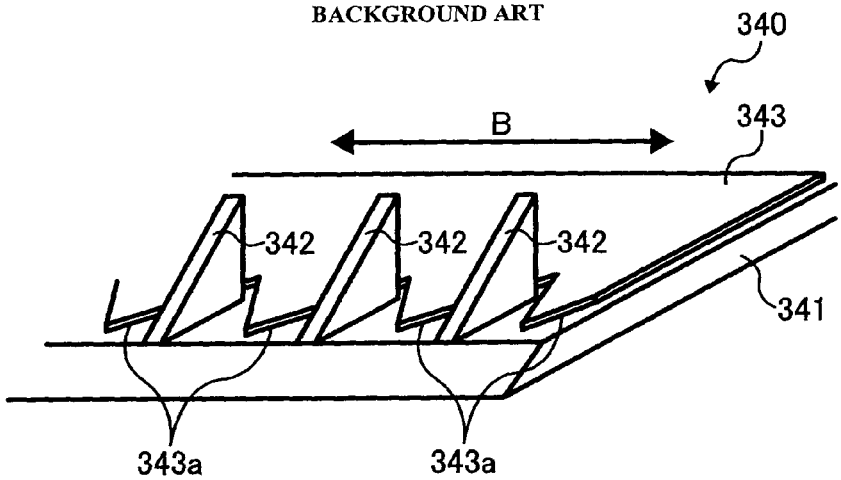
FIG. 1B BACKGROUND ART
FIG. 1B is an expanded view of a conventional neutralization unit in FIG. 1A.

By forming the contactable area D into a curved shape, the back face of the transfer sheet 25 may contact the rib 42 with smaller area compared to the rib 342 shown in FIG. 1B, wherein the rib 342 has a triangular shape.

Accordingly, frictional electric charge generated by a friction between the back face of the transfer sheet 25 and the ribs 42 may be suppressed.

The curvature radius of the curved shape is preferably set to 30 mm less. The curvature radius of the curved shape is more preferably set to 10 mm or less, and is further preferably set to 7 mm or less.

Figure 10:
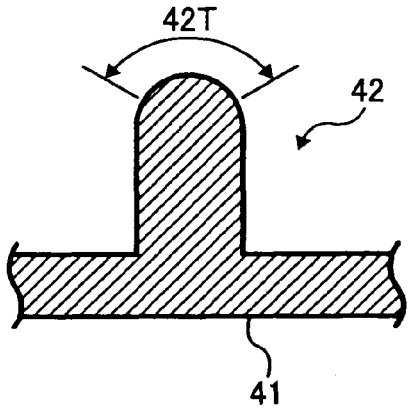
FIG. 10 is a schematic front cross-sectional shape of a rib, cut in line K-K shown in FIG. 9.

FIG. 10 is a schematic front cross-sectional view of the contactable area D of the rib 42, cut in the line K-K shown in FIG. 9.

As shown in FIG. 10, the contactable area D of the rib 42 has a rounded top area 42T when the contactable area D is cut in the in the line K-K in FIG. 9.

Therefore, the back face of the transfer sheet 25, which has just passed through the secondary transfer nip, may contact the rib 42 at the rounded top area 42T, by which the transfer sheet 25 and the rib 42 may contact each other at a smaller frequency.

Accordingly, the back face of the transfer sheet 25 may contact the rib 42 with a smaller frequency compared to the rib 342 shown in FIG. 1B, by which frictional electric charge generated by a friction between the ribs 42 and the back face of the transfer sheet 25 may be suppressed.

Figure 2:
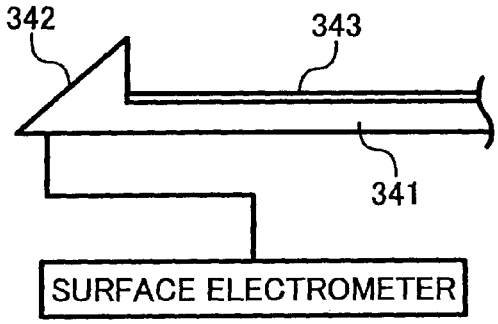
FIG. 2 BACKGROUND ART
FIG. 2 is a schematic view explaining a system for measuring electric charge on a neutralization unit.

An image produced by the image forming apparatus 500 having the neutralization unit 40 was evaluated, and it was confirmed that an occurrence of streak lines in the image was effectively suppressed. The electric charge generated on the rib 42 was measured by a measuring system shown in FIG. 2, and it was confirmed that a potential of the electric charge on the rib 42 was relatively small (e.g., +1,000 V) even when a number of sheets are printed continuously.

Another example for a neutralization unit is explained with reference to FIG. 11.

Figure 11:
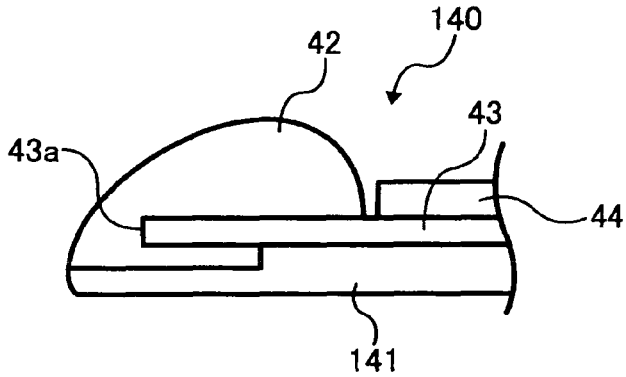
FIG. 11 is a schematic side cross-sectional view of another rib and electric-charge removing member in another embodiment of the neutralization unit.

FIG. 11 is a schematic side cross-sectional view of a neutralization unit 140, viewed from the longitudinal direction B of the electric-charge removing member 43.

As shown in FIG. 11, the neutralization unit 140 includes a support plate 141, the rib 42, and the electric-charge removing member 43.

As shown in FIG. 11, the neutralization unit 140 includes a charge-discharging space around the exposed areas 43*a* of the electric-charge removing member 43.

Specifically, a space is provided between one side of the exposed areas 43*a* and the support plate 141, which faces the exposed areas 43*a*.

As shown in FIG. 11, the other side of the exposed areas 43*a* is exposed to the outside as similar to the exposed areas 43*a* in FIG. 6.

Furthermore, another space is provided between the side face of the exposed areas 43*a* and the rib 42, although not shown in FIG. 9.

By providing such charge-discharging space, electric charge can be efficiently discharged at the exposed areas 43*a* of the electric-charge removing member 43.

With such configuration, electric charge can be efficiently removed from the back face of the transfer sheet 25 by the neutralization unit 140, wherein such charging efficiency may be equal to or greater than the charging efficiency of the neutralization unit 40 shown in FIGS. 6 and 9.

Another example of a neutralization unit is further explained with reference to FIG. 12.

Figure 12:
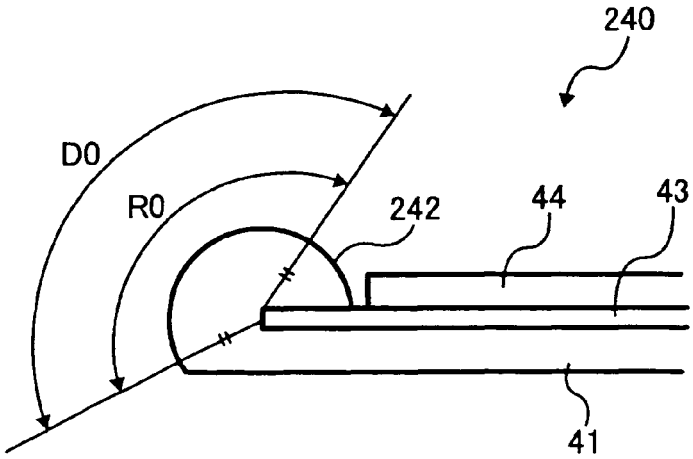
FIG. 12 is a schematic side cross-sectional view of another rib and electric-charge removing member in another embodiment of the neutralization unit.

FIG. 12 is a schematic side cross-sectional view of a neutralization unit 240, viewed from the longitudinal direction B of the electric-charge removing member 43.

As shown in FIG. 12, the neutralization unit 240 includes the support plate 41, a rib 242, and the electric-charge removing member 43.

As similar to the neutralization unit 40 shown in FIG. 9, the rib 242 of the neutralization unit 240 includes a curved shaped contactable area D0.

The back face of the transfer sheet 25, which has passed through the secondary transfer nip, may contact the contactable area D0 of the rib 242.

Different from the neutralization unit 40 shown in FIG. 9, the contactable area D0 has a single curvature R0, and the center of the curvature R0 is aligned to an end edge of the exposed area 43*a*.

Accordingly, any points on a peripheral edge of the contactable area D0 may be substantially the same distance away from the end edge of the exposed area 43*a*.

The back face of the transfer sheet 25 may contact such peripheral edge of the contactable area D0 of the rib 242.

Therefore, even if the back face of the transfer sheet 25 contacts the rib 242 at any point on the peripheral edge of the contactable area D0, a distance between the back face of the transfer sheet 25 and the end edge of the exposed area 43*a* may be maintained as a substantially same distance.

Accordingly, the neutralization unit 240 can remove electric charge from the back face of the transfer sheet 25 in a stable manner.

Another image forming apparatus, which can be used with any one of the above-described neutralization units, is explained with reference to FIG. 13.

Figure 13:
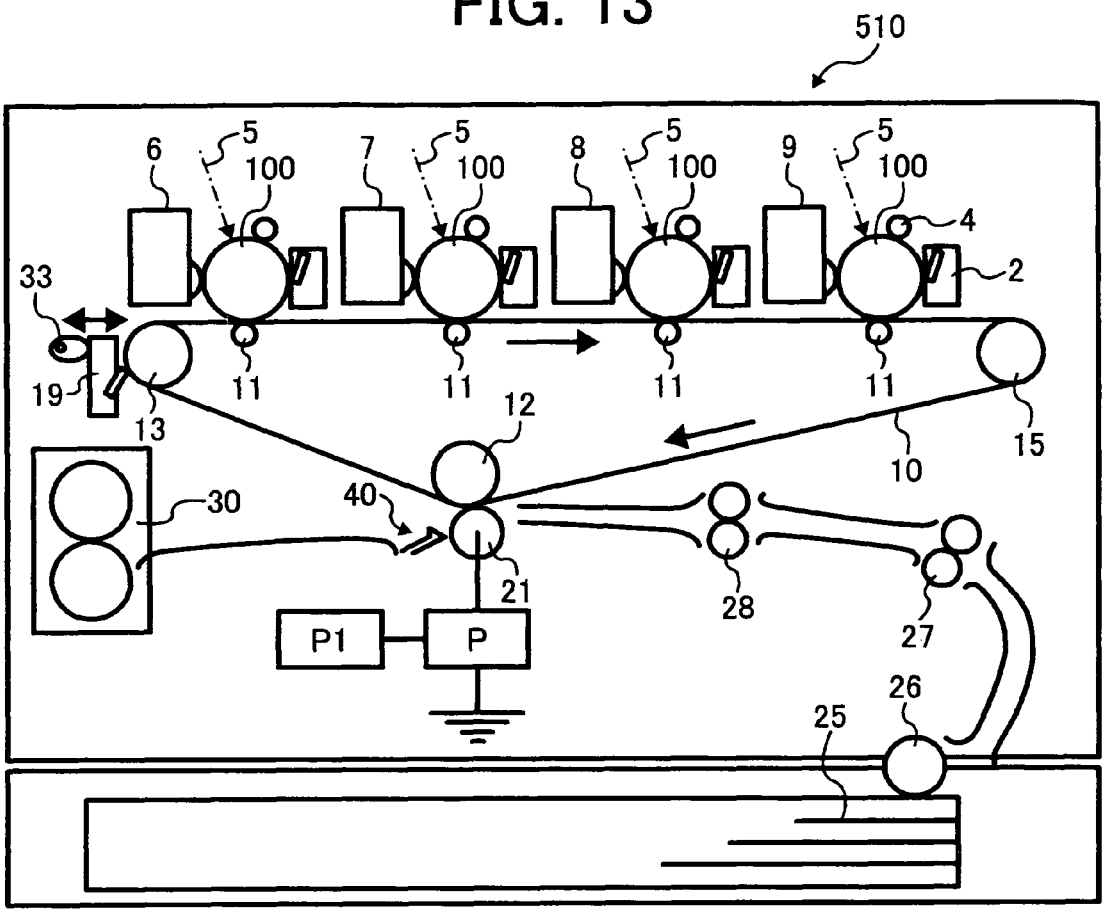
FIG. 13 is another schematic configuration for an embodiment of an image forming apparatus.

FIG. 13 is a schematic configuration of an image forming apparatus 510 using any one of the above-described neutralization units.

As shown in FIG. 13, the image forming apparatus 510 includes four photoconductive drums 100, the intermediate transfer belt 10, the neutralization unit 40, and the fixing unit 30.

The photoconductive drums 100 are arranged in a tandem manner and images are transferred from the photoconductive drums 100 to the intermediate transfer belt 10.

Each of the photoconductive drums 100 is provided with the cleaning unit 2 for cleaning the photoconductive member 100, the charger 4 for uniformly charging the photoconductive member 100, the optical writing unit 5 for writing a latent image on the photoconductive drum 100, and a developing unit (i.e., developing unit 6, 7, 8, and 9).

When a full-color image is produced with the image forming apparatus 510, each color toner image is superimposingly transferred to the intermediate transfer belt 10 from the photoconductive drums 100 with an order of yellow, magenta, cyan, and black, for example. In the image forming apparatus 510, the four-color image can be superimposed on the intermediate transfer belt 10 when the intermediate transfer belt 10 rotates in one cycle. Accordingly, the image forming apparatus 510 can print an image faster than the image forming apparatus 500 shown in FIG. 3.

As shown in FIG. 13, the above-described neutralization unit 40 is provided near to and downstream of the secondary transfer nip in the image forming apparatus 510. Instead of the neutralization unit 40, the neutralization units 140 and 240 can be used.

As similar to the image forming apparatus 500 shown in FIG. 3, frictional electric charge generated between the rib 42 and the transfer sheet 25 can be reduced in the image forming apparatus 510 shown in FIG. 13, and thereby an occurrence of streak lines can be effectively suppressed.

Hereinafter, another image forming apparatus, which can be used with any one of the above-described neutralization units, is explained with reference to FIG. 14.

Figure 14:
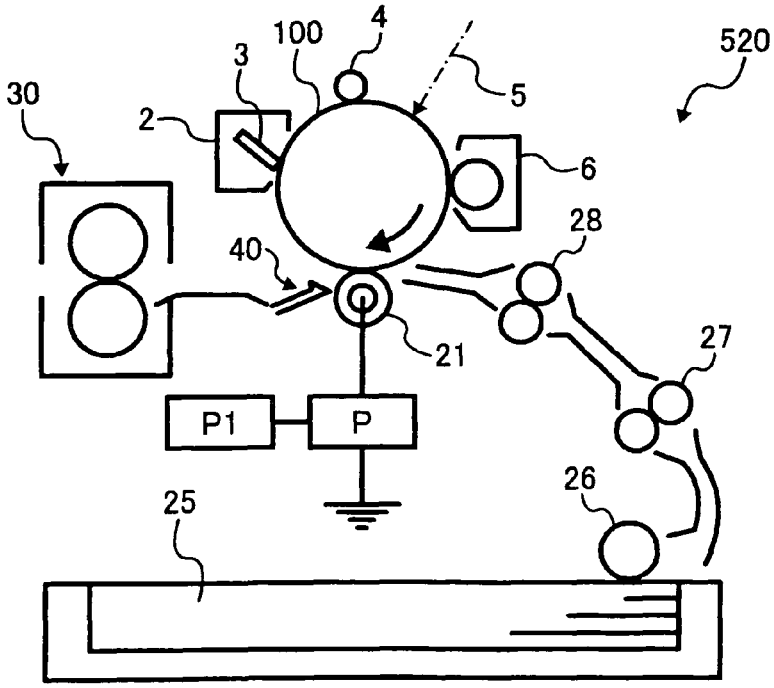
FIG. 14 is another schematic configuration for an embodiment of an image forming apparatus.

FIG. 14 is a schematic configuration of an image forming apparatus 520 using any one of the above-described neutralization units.

The image forming apparatus 520 includes the photoconductive drum 100 without an intermediate transfer member such as intermediate transfer belt. Accordingly, in the image forming apparatus 520, a toner image is directly transferred to the transfer sheet 25 from the photoconductive drum 100.

The photoconductive drum 100 is provided with the cleaning unit 2 for cleaning the photoconductive member 100, the charger 4 for uniformly charging the photoconductive member 100, the optical writing unit 5 for writing a latent image on the photoconductive drum 100, the developing unit 6, and the transfer roller 21.

When an image is produced with the image forming apparatus 520, a toner image on the photoconductive drum 100 is directly transferred to the transfer sheet 25 at a transfer nip formed by the photoconductive drum 100 and transfer roller 21.

As shown in FIG. 14, the above-described neutralization unit 40 is provided near to and downstream of the secondary transfer nip. Instead of the neutralization unit 40, the neutralization units 140 and 240 can be used.

As similar to the image forming apparatus 500 shown in FIG. 3, frictional electric charge generated between the rib 42 and the transfer sheet 25 can be reduced in the image forming apparatus 520 shown in FIG. 14, and thereby an occurrence of streak lines can be effectively suppressed.

Furthermore, instead of applying an electric charge removing bias voltage to the electric-charge removing member 43, the neutralization unit 40, 140, and 240 can remove electric charge from the back face of the transfer sheet 25 by connecting the electric-charge removing member 43 to ground.

As described above, the toner particles used in these exemplary embodiments include polymerized toner, which can be made by a polymerization method. The toner particles used in these exemplary embodiments preferably have a first shape factor SF-1 of 100 to 180 and a second shape factor SF-2 of 100 to 180, as above discussed.

Such toner particles are preferable for improving transfer efficiency. However, such toner particles contact the other toner particles at one point. For example, such toner particles contact the other toner particles on the transfer sheet 25 or contact a surface of the transfer sheet 25 at one point (i.e., smaller area). Therefore, the adhesion (or absorbability) of the toner particles to the other toner particles or to the transfer sheet 25 may decrease, which results in an increase of the fluidity of the toner particles and the transferability of the toner. Such toner particles may move more easily due to an effect of frictional electric charges at the rib 42, by which a streak line may occur.

By providing any one of the neutralization unit 40, 140, 240 to an image forming apparatus using such toner particles, the image forming apparatus can maintain higher transfer efficiency and can suppress streak lines on a printed image.

Although the intermediate transfer belt, photoconductive drum, or photoconductive belt are explained in the above-description as an image carrying member, other types of image carrying members such as intermediate transfer drum manufactured by coating a surface of a metal cylinder with a rubber having a medium electric resistance can be used, for example.

Furthermore, although the electric-charge removing member 43 includes the plurality of exposed areas 43*a* by processing a metal plate into saw-tooth appearances, the electric-charge removing member 43 can be formed in other shapes for the plurality of exposed areas 43*a*. For example, a plurality of needle-like shapes can be formed as exposed areas 43*a* for removing electric charge.

Furthermore, although the transfer roller is used as transfer unit in the above-discussed example embodiments, other types of transfer unit such as a rotatable transfer brush, a transfer belt, a transfer brush, a transfer blade, and a transfer plate can be used, for example.

Furthermore, the above-discussed neutralization units are used in an image forming apparatuses, in which toner images are transferred to a transfer sheet by applying a transfer bias voltage having a polarity opposite to the toner images at a transfer nip. In addition, the above-discussed neutralization units can be used in an image forming apparatus, in which a transfer bias voltage having a polarity, which is same as toner image, is applied at a transfer nip to transfer the toner images from an image carrying member to a transfer sheet.

Numerous additional modifications and variations are possible in light of the above teachings. It is therefore to be understood that within the scope of the appended claims, the disclosure of the present invention may be practiced otherwise than as specifically described herein.

This application claims priority from Japanese patent application No. 2005-180320 filed on Jun. 21, 2005 in the Japan Patent Office, the entire contents of which is hereby incorporated by reference herein.

What is claimed is:

1. A neutralization unit for use in an image forming apparatus, comprising:

a support member made of an insulating material;

an electric-charge removing member made of an electrically conductive material and fixed on the support member, the electric-charge removing member configured to remove electric charge from a back face of a recording medium after a toner image is transferred to a front face of the recording medium at a transfer nip, the electric-charge removing member comprising a plurality of exposed areas arranged along a longitudinal direction of the electric-charge removing member, the longitudinal direction of the electric-charge removing member is perpendicular to a transport direction of the recording medium; and a rib provided on the support member, said rib having a convex rounded surface extending from the support member, said convex rounded surface being rounded in a direction of transportation of the recording medium from the transfer nip, said rib being made of an insulating material, said rib protruding above an upper surface of the electric-charge removing member, said rib being disposed to be contactable with the back face of the recording medium when the recording medium is transported from the transfer nip.

2. The neutralization unit according to claim 1, wherein the convex rounded surface of the rib has a radius of curvature in the direction of transportation of the recording medium from the transfer nip of 30 mm or less.

3. The neutralization unit according to claim 1, wherein the convex rounded surface of the rib has a plurality of curvatures in the direction of transportation of the recording medium from the transfer nip.

4. The neutralization unit according to claim 1, wherein the convex rounded surface of the rib has a single curvature, and any point on the convex rounded surface of the rib is a substantially equal distance away from an end edge of the electric-charge removing member.

5. The neutralization unit according to claim 1, wherein the electric-charge removing member is made of a metal plate having a plurality of saw-tooth appearances on one side of the metal plate, and wherein the plurality of saw-tooth appearances are the exposed areas.

6. The neutralization unit according to claim 1, further comprising a voltage applying unit, connected to the electric-charge removing member and configured to apply a bias voltage, having a same polarity as that of toner, to the electric-charge removing member.

7. The neutralization unit according to claim 1, wherein the exposed areas of the electric-charge removing member are surrounded with a space for discharging electric charge.

8. The neutralization unit according to claim 1, wherein the electric-charge removing member is grounded.

9. The neutralization unit according to claim 1, further comprising a cover member configured to cover the electric-charge removing member without covering the exposed areas.

10. The neutralization unit according to claim 1, wherein said rib is disposed to prevent the recording medium from directly contacting the electric-charge removing member while the recording medium is transported from the transfer nip.

11. An image forming apparatus, comprising:

an image carrying member configured to carry an image formed with toner thereon;

a transfer unit configured to transfer the image from the image carrying member to a recording medium at a transfer nip by generating a transfer electric field when the recording medium passes through the transfer nip;

a neutralization unit configured to remove electric charge from a back surface of the recording medium after the image is transferred to a front surface of the recording medium;

a support member made of an insulating material;

an electric-charge removing member made of an electrically conductive material and fixed on the support member, the electric-charge removing member configured to remove electric charge from a back face of the recording medium after the image is transferred to the front face of the recording medium at the transfer nip, the electric-charge removing member comprising a plurality of exposed areas along a longitudinal direction of the electric-charge removing member, the longitudinal direction of the electric-charge removing member is perpendicular to a transport direction of the recording medium; and a rib provided on the support member, said rib having a convex rounded surface extending from the support member, said convex rounded surface being rounded in a direction of transportation of the recording medium from the transfer nip, said rib being made of an insulating material, said rib protruding above an upper surface of the electric-charge removing member, said rib being disposed to be contactable with the back face of the recording medium when the recording medium is transported from the transfer nip.

12. The image forming apparatus according to claim 11, wherein the neutralization unit is provided downstream of the transfer nip while avoiding a placement of the rib on a nip tangent line extended from the transfer nip.

13. The image forming apparatus according to claim 11, wherein the toner includes a polymerized toner.

14. The image forming apparatus according to claim 11, wherein the toner has a first shape factor SF-1 having a range of 100 to 180, and a second shape factor SF-2 having a range of 100 to 180.

15. A neutralization unit for use in an image forming apparatus, comprising:

means for supporting, the means for supporting being made of an insulating material;

means for removing electric charge from a back face of the recording medium after a toner image is transferred to a front face of a recording medium at a transfer nip, the means for removing being made of an electrically conductive material and fixed on the means for supporting, the means for removing comprising a plurality of exposed areas along a longitudinal direction of the means for removing, the longitudinal direction of the means for removing is perpendicular to a transport direction of the recording medium; and a rib provided on the means for supporting, said rib having a convex rounded surface extending from the means for supporting, said convex rounded surface being rounded in a direction of transportation of the recording medium from the transfer nip, said rib being made of an insulating material, said rib protruding above an upper surface of the means for removing electric-charge, said rib being disposed to be contactable with the back face of the recording medium when the recording medium is transported from the transfer nip.

* * * * *